US006041579A

United States Patent [19]

Savoury et al.

[11] Patent Number: 6,041,579

[45] Date of Patent: Mar. 28, 2000

[54] BAG FORMING MACHINE WITH STRAW INSERTING MECHANISM

[75] Inventors: Rick Savoury, Markham, Canada; Raymond L. Larson, Fargo, N. Dak.

[73] Assignee: Beach, LLC, Rapid City, S. Dak.

[21] Appl. No.: 08/854,414

[22] Filed: May 12, 1997

[51] Int. Cl.[7] ..... B65B 09/06

[52] U.S. Cl. ..... 53/551; 53/552; 53/236; 53/239

[58] Field of Search ..... 53/155, 236, 239, 53/445, 450, 451, 474, 550, 551, 552

[56] References Cited

U.S. PATENT DOCUMENTS

| | | | |
|---|---|---|---|
| 2,992,118 | 7/1961 | Daline . | |
| 3,019,575 | 2/1962 | Charley et al. | 53/236 X |
| 3,038,281 | 6/1962 | Quisel | 53/440 |
| 3,074,612 | 1/1963 | Schneider . | |
| 3,144,976 | 8/1964 | Freshour . | |
| 3,545,604 | 12/1970 | Gunther | 53/474 X |
| 3,596,433 | 8/1971 | Bertoglio | 53/567 |
| 3,851,441 | 12/1974 | Marchand | 53/239 X |
| 3,861,121 | 1/1975 | Monsees | 53/239 |
| 3,889,446 | 6/1975 | Simmons et al. | 53/551 X |
| 3,968,901 | 7/1976 | Peva | 53/236 X |
| 4,614,074 | 9/1986 | Evers | 53/410 X |
| 4,631,905 | 12/1986 | Maloney | 53/555 X |
| 5,014,493 | 5/1991 | West | 53/552 X |
| 5,054,270 | 10/1991 | McMahon | 53/552 |
| 5,067,302 | 11/1991 | Boeckmann | 53/552 X |
| 5,231,817 | 8/1993 | Sadler | 53/552 X |
| 5,255,497 | 10/1993 | Zoromski et al. | 53/552 X |

*Primary Examiner*—Daniel B. Moon

[57] ABSTRACT

A machine for making sealed liquid pouches with a free-floating straw inside the pouch is described. The machine comprises a vertical pouch former which forms a continuous plastic film tube from a film sheet with the plastic film tube disposed about a liquid dispensing spout. A straw convecting tube also extends to one side of the liquid dispensing spout inside the tube. A straw is released through the convecting tube at predetermined intervals in synchronism with a transverse sealer which forms a bottom and top edge seal of pouches as liquid is continuously dispensed through the liquid dispensing tube. The plastic film tube is maintained in a transversely expanded condition during the filling of the pouch and is advanced by an engagement mechanism between the sealing cycles.

15 Claims, 4 Drawing Sheets

FIG 1
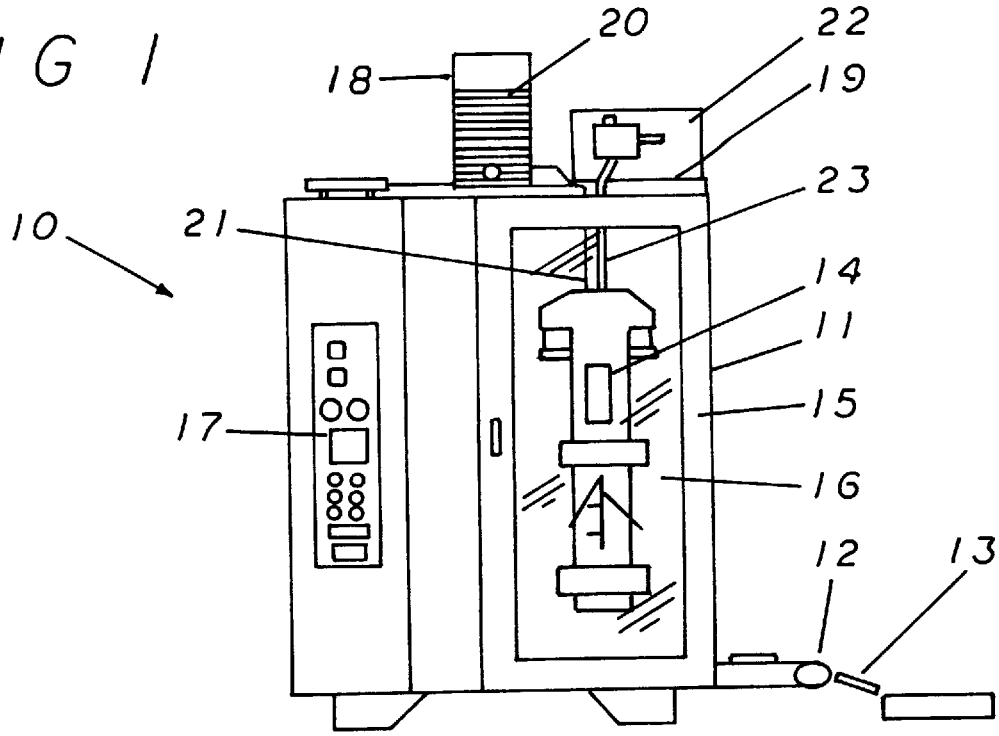
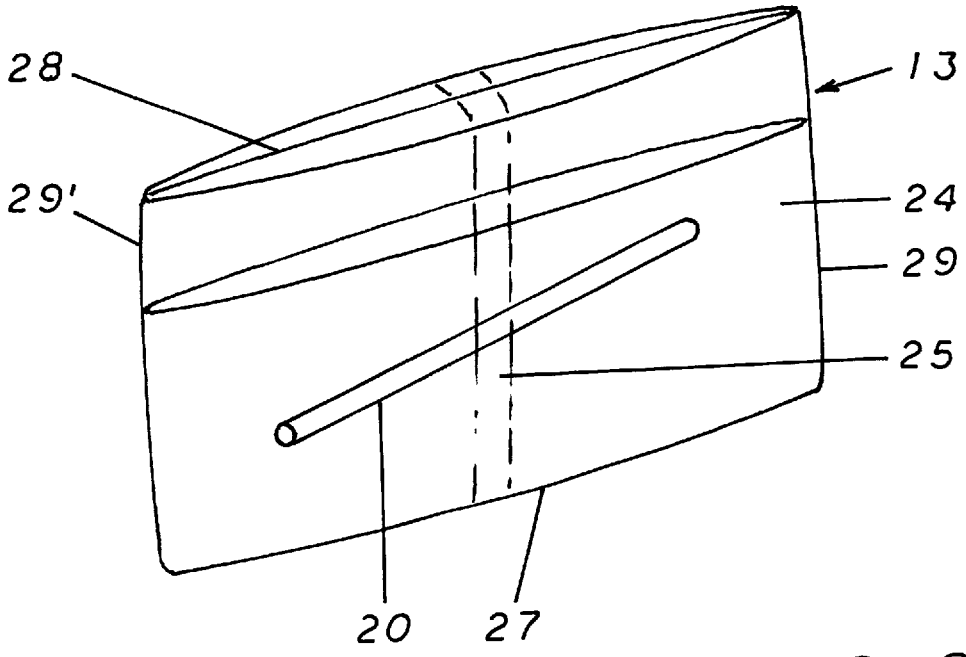
FIG 2

FIG 6
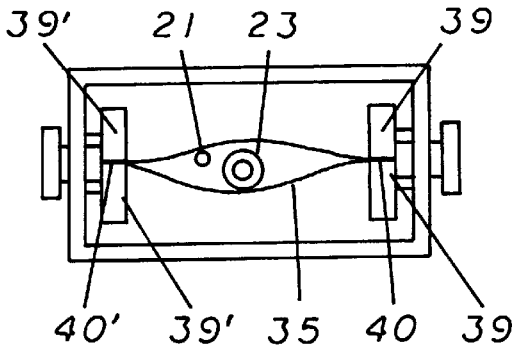
FIG 7A
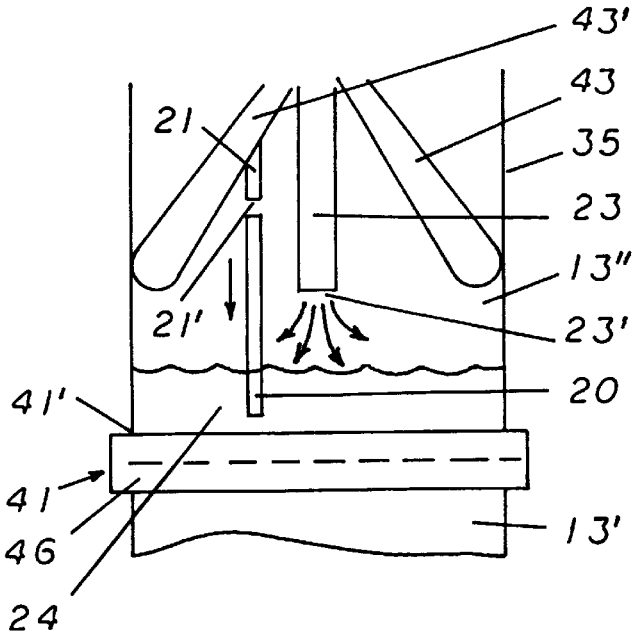
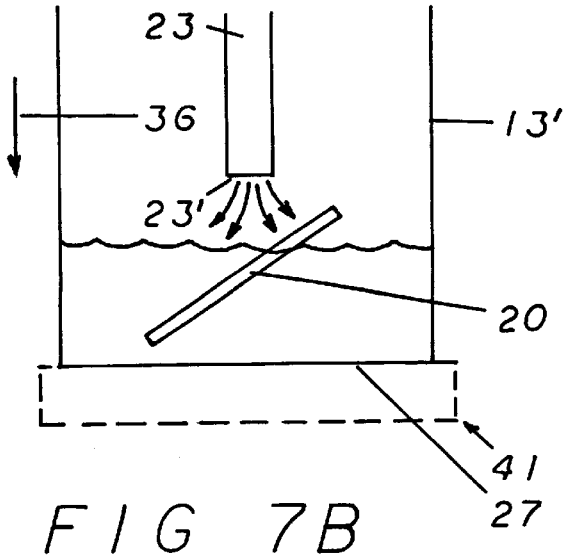
FIG 7B
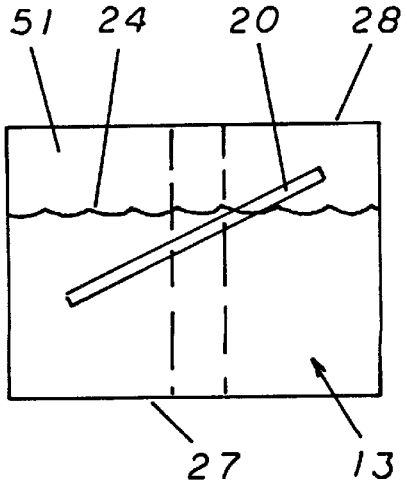
FIG 7C

BAG FORMING MACHINE WITH STRAW INSERTING MECHANISM

TECHNICAL FIELD

The present invention relates to a machine and method for making a sealed liquid pouch having a free-floating straw inside the pouch and more particularly to the means and method for inserting the straw within the pouch during the filling cycle of the pouch.

BACKGROUND ART

It is known to manufacture plastic film liquid pouches with a free-floating straw positioned therein. Certain methods of manufacture utilize forming the pouches by folding a film sheet horizontally and placing a straw in the lower folded section of the film strip well before the seals are made to produce an open-ended pouch with a straw therein ready to receive liquid. However, when producing such pouches from vertical forming machines where the film tube is formed in a vertical manner and particularly in a continuously liquid dispensing application, this task becomes much more difficult as the straw must be positioned within the bag being formed as liquid is admitted in the bag due to the continuous liquid dispensing process. This poses several problems, one being the manner in which the straws can be dispensed into the liquid pouch being filled and also in synchronism with the pouch sealing cycle. Another problem is to ensure that the straw does not extend into the seal jaws after the open-ended pouch formed in the plastic tube is disposed for sealing the open top end to form the pouch. Another problem is to adapt straw dispensing mechanism to such bag forming and filling machines. It is also desirable, during the manufacture of these sealed liquid pouches, to evacuate some air from the space which is formed in the bag and which is necessary to provide for the expansion of the liquid, when it is frozen. It is also desirable, as pointed out in our U.S. Pat. No. 5,782,344 entitled "Liquid Plastic Film Pouch with Inner Straw" to evacuate a certain quantity of air from the space within the pouch whereby to render the pouch more manipulative to grasp the straw and puncture the bag with the straw to extract its liquid.

SUMMARY OF INVENTION

It is therefore a feature of the present invention to provide a machine and a method for making a sealed liquid pouch with a free-floating straw inside the pouch, and which substantially overcomes the above-mentioned disadvantages.

Another feature of the present invention is to provide a machine for making sealed liquid pouches with a free-floating straw inside the pouch and wherein the straw is convected inside the pouch, during the formation of the pouch, by a convection tube and through which the straw freely falls by gravity.

Another feature of the present invention is to provide a machine for making a sealed liquid pouch with a free-floating straw inside the pouch and wherein the straw is inserted within the pouch being formed during the displacement cycle of the plastic film tube which forms the pouch.

Another feature of the present invention is to provide a machine for making a sealed liquid pouch with a free-floating straw inside the pouch and wherein the formed plastic film tube is continuously stretched laterally during the filling cycle and sealing cycles and in conjunction with the sealing jaws permits a certain quantity of air to be evacuated from the free space in the pouch being formed.

Another feature of the present invention is to provide a method of producing a sealed liquid pouch having a free-floating straw located in the pouch and wherein a straw is simultaneously directed in the liquid through a convection tube as the bag is being filled and the tube being drawn to a sealing head.

Another feature of the present invention is to further provide a method of producing a sealed liquid pouch with a free-floating straw and wherein air is evacuated from the space within the pouch during the formation of the pouch.

According to the above features, from a broad aspect, the present invention provides a machine for making a sealed liquid pouch with a free-floating straw inside the pouch. The machine comprises bag forming means for making a bag from impervious plastic film material. A filler mechanism is provided for placing a liquid inside the bag. A straw convecting means is provided for directing a straw in the pouch prior to sealing the pouch.

According to a further broad aspect of the present invention there is provided a method of producing a sealed liquid pouch having a free-floating straw located in the liquid within the pouch. The method comprises the steps of folding and sealing a plastic film sheet to form a film tube having an open-top end. Liquid is inserted in the film tube and simultaneously a straw is directed through a straw convection tube for discharge into the liquid in the plastic film tube. The plastic film tube is displaced downwardly to a sealing jaw where a seal is formed at an open top end of a filled film tube section to form the sealed liquid pouch. The seal also forms a bottom edge seal of another tube section being filled.

BRIEF DESCRIPTION OF DRAWINGS

A preferred embodiment of the present invention will now be described with reference to the accompanying drawings in which:

FIG. 1 is a simplified perspective view showing a machine constructed in accordance with the present invention for making filling and inserting a straw in the liquid contained within a liquid pouch;

FIG. 2 is a perspective view showing the liquid pouch with the free-floating straw therein and formed in accordance with the present invention;

FIG. 6 is a top schematic view showing the construction of the plastic tube engaging and displacing mechanism; and FIGS. 7A to 7C are schematic plan views showing the dispensing of the straw within the plastic bag being formed.

DESCRIPTION OF PREFERRED EMBODIMENTS

Figure 3:
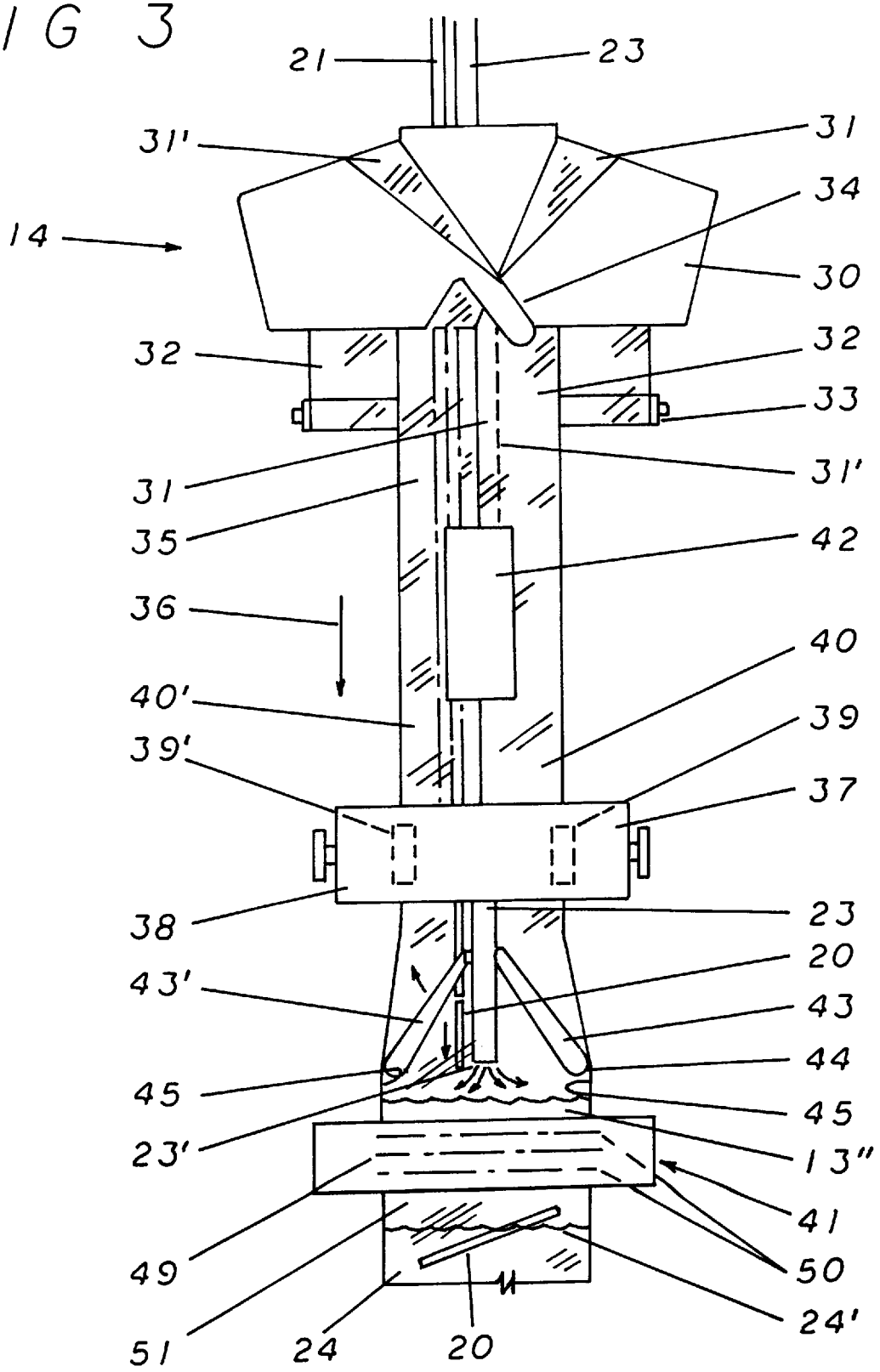
FIG. 3 is a simplified schematic view showing the manner in which the film sheet is formed into a vertical plastic tube to form the pouches as shown in FIG. 2.

Referring now to the drawings and more particularly to FIG. 1, there is shown a vertical pouch forming machine 10 which comprises a housing 11 having a dispensing conveyor 12 thereunder for dispensing liquid pouches 13 that are formed by the machine. Because the liquid contained within the pouches 13 is for human consumption, it is important to maintain the machine in a sanitary environment and for this reason the vertical bag-forming mechanism 14 is located inside the housing 11 with air evacuated therefrom and access thereto is provided by a door 15 having a transparent glass panel 16 to provide visual access to the machine to visualize the operation thereof and to detect any malfunctions of its mechanisms. A control panel 17 provides adjustment and control for the various mechanisms within the machine. A straw dispensing magazine 18 is conveniently positioned on the top wall 19 of the housing 11 and feeds, in a synchronized manner, straws 20 from the magazine to the top end of a straw dispensing tube 21 which extends to or over the top end 19. A liquid reservoir 22 or a feed pipe (not shown) feeds liquid to a dispensing filler tube or spout tube 23.

As shown in FIG. 2, the vertical forming machine 10 forms the sealed liquid pouch 13 which contains therein a substantially predetermined quantity of liquid 24 and a straw 20 which is freely floating therein. During the formation of the bag from a sheet of film material, a transverse seal 25 is formed across one of the side panels 26 of the bag 13 and opposed side edge seals 27 and 28 are also formed. The end edges 29 and 29' do not have seals as they were formed by folding the plastic film sheet, as will be described later. The end edge 29' may constitute the top end of the formed bag. The side panels 26 usually contain printed matter as is described in our above-referenced co-pending patent application.

Referring now to FIG. 3 there is schematically illustrated the construction of the vertical bag-forming mechanism 14. It comprises a plastic film tube forming head 30 which gathers opposed side edge portions 31 and 31' of a film sheet 32 which is pulled from a roll of film material, not shown, and conveniently located within the housing 11 or externally of the housing and guided by guide rolls 33. This forming head is known in the art and its purpose is to fold the sheet and overlap the side edge portions 31 and 31' by guiding the side edge portions about the head 30 and under a guide finger 34. This forms a hollow plastic tube 35. As hereinshown and with further reference to FIG. 6, it can be seen that this hollow plastic film tube 35 is formed about the filler spout 23 as well as the straw dispensing tube 21 which extends in a side-by-side relationship with the filler tube 23. The hollow plastic film tube 35 is advanced or pulled in a downward direction, as indicated by arrow 36 by a tube engaging drive mechanism 37. As shown in FIG. 6, this tube engaging drive mechanism comprises a stationary support frame 38 in which is supported opposed pairs of film engaging drive wheels 39 and 39'. Each pair of drive wheels 39, 39' engage an outer side edge portion 40 and 40' of the film tube 35. A drive motor, not shown herein, actuates these wheels which are in frictional engagement from opposed sides of the side edge portions 40 and 40' of the film tube 35 whereby to draw the film downwardly through the frame 38, a predetermined distance as adjusted by the speed and time of operation of the wheels. This tube engaging drive 37 is only actuated between the opening and closing cycles of the sealing mechanism 41 which will be described later.

With further reference to FIG. 3, while the sealing mechanism 41 is actuated, there is further actuated in synchronism therewith, a vertical sealing mechanism 42 which seals the overlapped outer edge portions 31 and 31' of the film sheet 32 along a predetermined length. Accordingly, below the vertical sealing head 42 there is formed an open-ended hollow plastic film tube. The vertical sealer is well known in the art and will not be described in detail herein. The filler tube or liquid dispensing spout 23 has a liquid dispensing end 23' positioned a predetermined distance above the sealing mechanism 41. A tube expanding means in the form of a pair of outwardly biased pusher arms 43 and 43' are secured to opposed sides of the filler spout adjacent the liquid dispensing end 23' thereof and are spring-biased outwardly by a spring mechanism not shown herein. These pusher arms 43 have smoothly curved outer ends 44 and are of narrow thickness whereby to engage the inner side ends 45 of the hollow plastic film tube 35. Their purpose is to maintain the tube taught and expanded in the area of the liquid dispensing lower end of the filler spout and also in the area of the transverse sealing mechanism 41 in order to eliminate creasing along the seal.

Figure 5A:
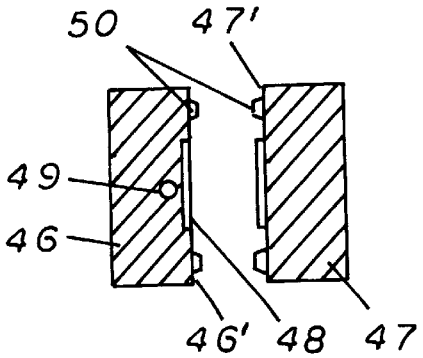
FIG. 5A is a simplified section view showing the construction of the sealing jaws.

As shown in FIG. 5A, the transverse sealing mechanism 41 is constituted by a pair of jaw plates 46 and 47 with the jaw plate 47 constituting a bumper and displaceable against the jaw plate 46 which is provided with a sealing diaphragm 48 behind which a sealing wire 49 extends to form a seal across the plastic tube 35. A pair of gripper elements 50 are also provided in the inner faces 47' and 46' of the jaw plates 47 and 46, respectively, whereby to engage a top end portion of the lower filled pouch 13' and a lower bottom end portion of the upper tube section of the bag 13" being formed. As can be seen, because these sealing heads project from the inner faces of the jaw plates, they also expulse a small quantity of air from the space 51 above the liquid level 24' of the liquid 24 in the pouch 13', when closed.

Figure 5B:
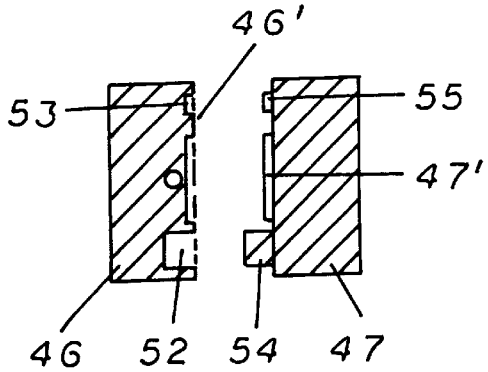
FIG. 5B is a view similar to FIG. 5A but showing a modification of the sealing jaws to provide a means to expulse air from the bag being formed.

FIG. 5B shows a modification of the jaw plates 46 and 47 and as hereinshown the inner face 46' of the jaw plate 46 is provided with a pair of cavities, namely a lower cavity 52 and an upper cavity 53. The lower cavity is deeper than the upper cavity and these longitudinal cavities are shaped to receive therein longitudinal protrusions or bars 54 and 55, respectively. The lower protrusion 54 extends from the inner face 47' of the jaw plate 47 a distance greater than the other protrusion 55. The reason for this is as the jaw plates 46 and 47 close, the lower protrusion 47' will expulse air from the space 51 as the opposed walls of the plastic film tubes collapse in a split second before the other protrusion 55 engages an upper part of the bag walls prior to the sealing wire 49 contacting the collapsed walls to form the seal. The upper protrusion 55 only performs a bag grasping and collapsing operation. It is important to grasp the lower end of the bag above the sealing head as liquid is continuously fed into the hollow tube by the spout.

Referring now to FIG. 5, there will be described the construction and operation of the straw storage and convecting means. As shown in FIG. 3, the straw convection tube 21 is a straight tube which extends from an upper straw receiving end 21' to a lower dispensing end 21". As better seen in FIG. 4, the straw dispensing magazine 18 is a storage container, loaded from the top, and herein formed of transparent plastic material and has opposed parallel side walls 60 and opposed end walls 61. The top portion of the magazine is substantially rectangular and dimensioned to contain a plurality of the straws 20 therein and all oriented in a substantially parallel manner. The bottom end of the rectangular upper portion has a funnel-shaped lower section 62 whereby to direct straws into a dispensing throat portion 63 at the bottom of the lower section 62. Straws are aligned in this throat portion in parallel side-by-side relationship and in a single row 64 as hereinshown. A straw access aperture 65 is formed in at least one of the space side wall extensions 66 which forms the dispensing throat portion 63. The access aperture may also be provided in the opposed side wall 66 and this permits access to the straws should there be blockage or a malfunction in the throat area.

Transfer means in the form of a piston actuated pusher rod 67 is also provided. The pusher rod 67 is secured to a piston cylinder 68 for axial displacement of the pusher rod. The pusher rod is reciprocated at between 40 to 60 lbs pressure. The pusher rod has a straw engaging end 69 and the rod is dimensioned so as to extend through a discharge opening 70 formed at the bottom of the dispensing throat portion 63 whereby to engage an end of the lowermost one of the straws 20, and shoot it out of the dispensing throat portion 65 at a high velocity and into a guide tunnel 71. Because the pusher rod 67 extends through the discharge opening 70 the straw which was lying on top of the discharged straw within the discharge throat portion cannot fall into the discharge opening 70 due to the fact that it is occupied by the pusher rod which is of circular cross-section much like the straw. The piston cylinder 68 is also operated in synchronism with the transverse sealing mechanism 41.

Figure 4:
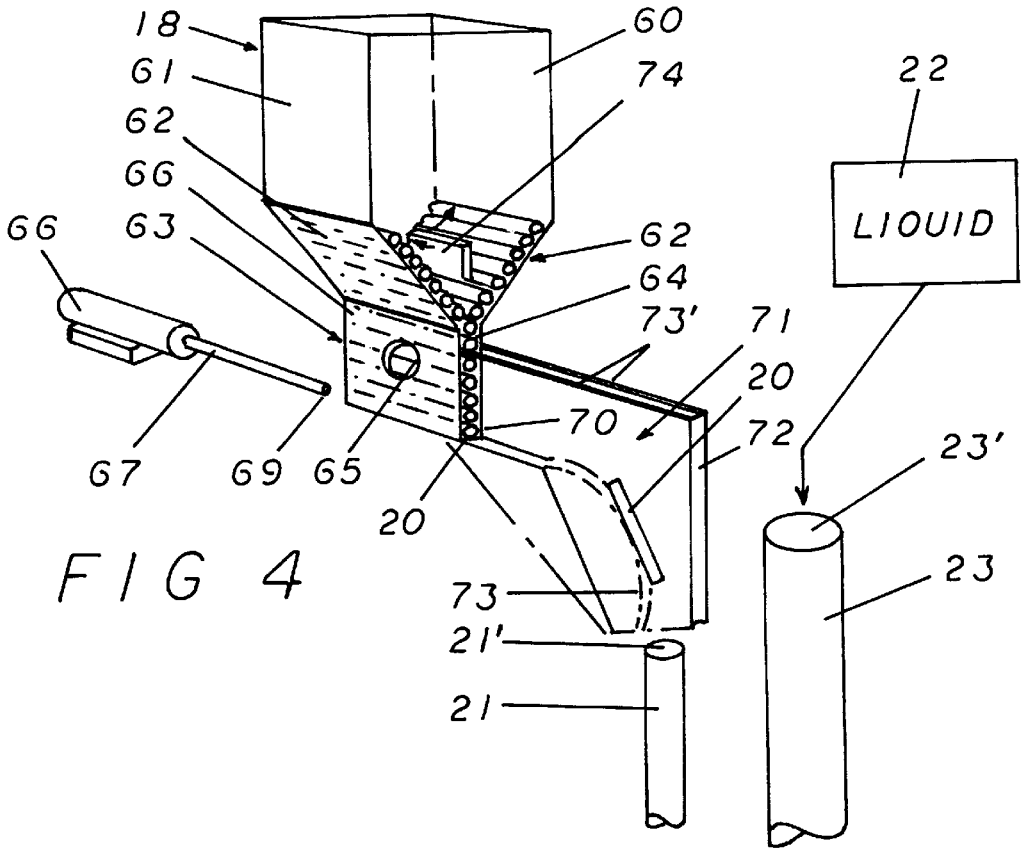
FIG. 4 is a schematic perspective view showing the straw storage and dispensing mechanism of the present invention.

As shown in FIG. 4, the guide tunnel 71 is formed by opposed side walls 73 and a curved end wall 72 to maintain the straw oriented for discharge within the convection tube 21. The curved end wall 72 has a curved shape designed to cause the straw to orient itself from a horizontal position, at the discharge opening 70, to a vertical position and in a guided manner whereby the straw will enter the open top end 21' of the straw convection tube 21 and fall by gravity therein to be released within the bag. As hereinshown, an oscillating plate 74 is disposed in the funnel-shaped lower section 62 adjacent the top end of the dispensing throat section 63 whereby to cause the straws adjacent the dispensing throat section, to adopt a substantially parallel orientation.

Although not shown it is also contemplated that a loading and discharging turret may be provided between the discharge opening 70 of the straw dispensing magazine 18 and the open top end 21' of the straw convection tube 21. The turret would have four straw receiving cavities disposed at 90 degrees to one another and wherein the pusher rod 67 would push the lowermost one of the straws 20 into one of the straw receiving cavities. The turret would then be indexed or displaced 90 degrees and at the same time clamping the loaded straw in position. When the straw receiving cavities reach a vertical position after 270 degrees of rotation, the retention means or straw clamping means would release whereby the straw at the 270 degree position would be released in the open top end 21' of the straw convection tube 21.

Referring now to FIGS. 7A to 7C and particularly in FIG. 7A, it can be seen that the straw dispensing end 21" of the straw dispensing tube 21 is located a distance high enough from the dispensing end 23' of the liquid dispensing tube 23, and from the top edge 37' of the jaws 37, sufficiently to permit the straw 20 to be ejected from the dispensing tube 21 and into the liquid 24' which is quickly rising within the plastic film tube portion 13" being filled. As previously described, as the jaws 37 open, the plastic film tube 35 is drawn downwardly at a predetermined speed which is synchronized to the amount of liquid entering the hollow plastic film tube or pouch 13" being formed. One of these pouches can be formed approximately every second. Accordingly, as the straw 20 is released within the pouch being formed, the pulling action on the hollow plastic film tube 35 causes the straw to tilt freely towards the filler spout 23, as shown in FIG. 7B. This action is fairly quick as a bag is being formed in less than one second with about 75 percent of the bag filled with the liquid. As the straw tilts it clears the top portion of the bag 13' to be formed sufficient to clear the jaw plates 46 of the sealing mechanism 41.

Summarizing the method of operation, a sealed liquid pouch with a free-floating straw, as shown in FIG. 2, is formed by the steps of convecting a plastic sheet about a tube forming head to form a film tube having an open-top end whereby liquid can be inserted within the film tube through a filler spout 23. Simultaneously, a straw is directed through a straw convection tube 21 and is discharged within the plastic film tube in the liquid being dispensed in a pouch being formed. As the plastic tube is pulled downwardly, and the straw tilts whereby to clear sealing jaws which form a seal at an open top end of a filled film tube section to form the sealed liquid pouch and simultaneously to form a bottom edge seal of another tube section being filled. The straw is transferred from a straw storage magazine to a loading location where it is reoriented to enter an upper straw receiving end of the straw convection tube, which is a straight tube, and wherein the straw falls by gravity therethrough and into the pouch being formed. The plastic tube is continuously maintained in a stretch condition and by doing so the opposed walls are close together and this evacuates air from the space provided in the pouch. Leak-proof side edge seals are formed to constitute the sealed pouch. The sealing jaw plates are also provided with a gripping means which may be adapted to further expulse air from the space in the bag being formed as well as perform their gripping function as above-described.

It is within the ambit of the present invention to cover any obvious modifications of the preferred embodiment described herein, provided such modifications fall within the scope of the appended claims.

We claim:

1. A machine for making a sealed liquid pouch with a free-floating straw inside the pouch, said machine comprising bag-forming means for making a bag from impervious plastic film material, a filler mechanism for placing a liquid inside said bag, and a straw convecting means for directing a straw in said pouch prior to sealing said pouch, said straw convecting means being a convection tube through which said straw is convected by gravity, said tube having a lower dispensing end located in said bag at a predetermined position, said machine being a vertical bag forming machine having a vertically oriented filler spout located internally of a plastic film tube having a sealed bottom end, said filler spout having a liquid dispensing lower end, said lower dispensing end of said convection tube being disposed within said plastic film tube and spaced a predetermined distance immediately above said liquid dispensing lower end of said filler spout to release a straw in said plastic film tube during dispensing of liquid within said plastic film tube and preventing said straw to interfere with a transverse sealing mechanism, said bag forming means having a plastic film tube forming head for folding a film sheet and disposing opposed side edge portions of said film sheet in overlap relationship, a vertical sealer for sealing said overlapped side edge portions together to form said plastic film tube, a tube engaging drive mechanism for displacing said tube in a sequential manner, said transverse sealing mechanism forming a bottom and top seal across said tube, and tube expanding means to maintain said tube in a transverse expanded condition to effect an uninterrupted top seal of a filled plastic tube portion to form one of said sealed liquid pouches and a bottom seal of a plastic tube portion now being filled, said tube expanding means having a pair of outwardly biased pusher arms secured to opposed sides of said filler spout and frictionally engaging opposed inner side ends of said plastic film tube to maintain said tube expanded and taunt in the area of said liquid dispensing lower end of said filler spout and in the area of said transverse sealing mechanism.

2. A machine as claimed in claim 1 wherein said convection tube is a straight tube extending from an upper straw receiving end to said lower dispensing end.

3. A machine as claimed in claim 2 wherein there is further provided a straw dispensing magazine having a plurality of straws oriented in parallel relationship therein, said magazine having a dispensing throat portion in which straws are aligned in parallel side-by-side relationship, and transfer means to displace an outer end one of said straws from a discharge end of said dispensing throat portion to said upper straw receiving end of said convection tube in synchronism with said bag forming means.

4. A machine as claimed in claim 3 wherein said transfer means comprises a piston-actuated pusher rod aligned for pushing engagement with an end of said outer end one of said straws to shoot same into a straw orienting guide tunnel positioned above said upper straw receiving end of said convection tube.

5. A machine as claimed in claim 4 wherein said piston-actuated pusher rod is an elongated rod which extends through said discharge end of said dispensing throat portion during a straw ejection stroke to prevent a next outer end one of said straws from movement to said discharge end of said dispensing throat portion until said pusher rod has completely retracted from its straw ejection stroke.

6. A machine as claimed in claim 4 wherein said straw orienting guide tunnel is comprised by a guide tunnel having a curved lower guide wall, said straw being shot into said tunnel against a curved end wall whereby said straw will orient itself from a horizontal position to a vertical position in a guided manner by said tunnel and enter said upper straw receiving end of said convection tube where it falls by gravity.

7. A machine as claimed in claim 3 wherein said straw dispensing magazine is further provided with an oscillating plate whereby to maintain said straws in said magazine and adjacent said dispensing throat portion in substantially parallel orientation.

8. A machine as claimed in claim 3 wherein said dispensing throat portion is provided by a pair parallel spaced side wall extensions of said straw dispensing magazine, there being a straw access aperture in at least one of said spaced side wall extensions.

9. A machine as claimed in claim 1 wherein said transverse sealing mechanism is constituted by a pair of jaw plates, one of said plates having a sealing head, the other of said plates being a press plate, and gripping means associated with said pair of jaws to grip in a sealing fashion an upper end of a filled bag and a lower end of a bag being filled during a bag filling cycle.

10. A machine as claimed in claim 9 wherein said pair of jaw plates are further provided with air evacuation means to remove air from a top portion of said bag being filled as said jaws close and prior to forming said seals.

11. A machine as claimed in claim 10 wherein said air evacuation means is constituted by said gripping means being formed by large elongated protrusions extending from a matting surface of one of said jaw plates and cavities in said other of said jaw plates for receiving said protrusion therein, a lower one of said protrusions extending a greater distance from said matting surface than an upper one of said protrusion.

12. A machine as claimed in claim 9 wherein said filler spout is a continuous liquid discharge spout, said straw being discharged into said pouch immediately after said pair of jaw plates close, said tube engaging drive mechanism dispensing said plastic film tube downwardly during a filling cycle and after said jaw plates open, said straw exiting said dispensing end of said straw convecting tube during dispensing of liquid as said plastic film tube is drawn down, said straw tilting freely towards said filler spout in a partly submerged manner spaced downwardly from a top end portion of said pouch to be formed and below said jaw plates prior to said jaw plates closing again.

13. A machine as claimed in claim 1 wherein said bottom seal and top seal formed across said tube constitute opposed side edges of said pouch.

14. A machine as claimed in claim 1 wherein said pair of outwardly biased pusher arms are of narrow thickness whereby said plastic film tube when expanded has opposed side walls thereof closely spaced whereby not to have a large volume of air above the liquid and below a top edge seal of said pouch, said expanding means constituting an air evacuation means.

15. A machine as claimed in claim 1 wherein said tube engaging drive mechanism is a stationary drive frame having opposed pairs of film engaging drive wheels, each pair of drive wheels engaging therebetween an outer side edge portion of opposed outer side edge portions of said film tube, said pairs of wheels when actuated drawing said film tube a predetermined distance in a downward motion, said filler spout being an elongated tube extending inside said film tube and between said pairs of drive wheels.

* * * * *